US008296957B2

(12) United States Patent
Muehlemann

(10) Patent No.: US 8,296,957 B2
(45) Date of Patent: Oct. 30, 2012

(54) STACKABLE PIECES OF FLATWARE

(75) Inventor: Rolf Muehlemann, Schlattingen (CH)

(73) Assignee: Fostag Holding AG, Stein am Rhein (CH)

( * ) Notice: Subject to any disclaimer, the term of this patent is extended or adjusted under 35 U.S.C. 154(b) by 741 days.

(21) Appl. No.: 12/226,885

(22) PCT Filed: Mar. 6, 2007

(86) PCT No.: PCT/CH2007/000117

§ 371 (c)(1),
(2), (4) Date: Jun. 2, 2009

(87) PCT Pub. No.: WO2007/124606

PCT Pub. Date: Nov. 8, 2007

(65) Prior Publication Data

US 2010/0000096 A1 Jan. 7, 2010

(30) Foreign Application Priority Data

May 2, 2006 (CH) ..... 0717/06

(51) Int. Cl.
*A47G 21/02* (2006.01)

(52) U.S. Cl. ..... 30/142; 30/147

(58) Field of Classification Search ..... 30/142, 30/147–150, 322–328, 340; 206/499; D7/642, D7/643, 645, 653
See application file for complete search history.

(56) References Cited

U.S. PATENT DOCUMENTS

| | | | | | |
|---|---|---|---|---|---|
| 2,285,013 | A | * | 6/1942 | Burns | 30/165 |
| 2,456,481 | A | * | 12/1948 | Ballantyne et al. | 206/509 |
| 2,752,678 | A | | 7/1956 | Welch | |
| 2,824,369 | A | * | 2/1958 | Welch | 30/324 |
| 3,695,424 | A | * | 10/1972 | Cristy et al. | 206/455 |
| 4,524,512 | A | | 6/1985 | Formo et al. | |
| 5,388,600 | A | * | 2/1995 | Hart | 132/323 |
| D362,160 | S | * | 9/1995 | Brabeck et al. | D7/645 |
| 5,904,250 | A | | 5/1999 | De Schutter | |
| D536,222 | S | * | 2/2007 | Heiberg et al. | D7/645 |
| 2005/0155229 | A1 | | 7/2005 | Lee | |

FOREIGN PATENT DOCUMENTS

| | | |
|---|---|---|
| DE | 70 33 238 | 11/1970 |
| DE | 71 27 677 | 11/1971 |
| DE | 93 16 566.8 U1 | 1/1994 |
| EP | 0 129 495 A2 | 12/1984 |
| EP | 1 514 497 A1 | 3/2005 |

* cited by examiner

*Primary Examiner* — Stephen Choi
(74) *Attorney, Agent, or Firm* — Pauley Petersen & Erickson

(57) ABSTRACT

A stackable cutlery element having a handle and a functional element shaped onto the handle. To achieve maximum stability, the handle of the cutlery element is designed as a wall with longitudinal ribs arranged on the edge of both sides, so that an essentially H-shaped cross-section is formed. For additional stabilization, an end rib is arranged on the longitudinal end of the handle opposing the functional element on both sides of the wall. The end rib and the two longitudinal ribs on both sides are designed so that when the cutlery elements of this invention are stacked, the end rib and the longitudinal ribs of the first side of a cutlery element engage positively in the end rib and longitudinal ribs of the second side of the further cutlery element to connecting to them in the stacking direction.

4 Claims, 12 Drawing Sheets

STACKABLE PIECES OF FLATWARE

BACKGROUND OF THE INVENTION

1. Field of the Invention

This invention relates to a stackable cutlery element with a handle with a wall and a functional element shaped onto the handle.

2. Discussion of Related Art

Cutlery of plastic, in particular knives, spoons and forks, are widely used whether as disposable cutlery for single use or in places where plastic cutlery is preferred to metal cutlery for reasons of weight and safety, for example in an aircraft. Because cutlery elements are manufactured with relatively thin walls, for reasons of cost and weight, sufficient stability is achieved by suitable shaping. For example, handles with a T-shaped, H-shaped, S-shaped or U-shaped cross-section are conventionally used.

It may be desirable to stack several cutlery elements, for example for simpler erection of packaging units or for space-saving storage, particularly of cutlery elements intended for multiple use.

The state of the art provides different solutions for designing stackable cutlery elements with a U-shaped cross-section.

European Patent Reference EP 0,129,495 A2, for example, discloses stackable cutlery elements in the form of spoons, knives and forks, whose handles have an essentially U-shaped cross-section. The handle is designed so that the convex side of a handle can be arranged positively in the concave side of a further identical handle. A plurality of cutlery elements can be stacked in this manner. The shaping of the cutlery elements and the stack density that can be achieved are in this case limited because of the U-shaped design of the handle. Also, the individual cutlery elements may become stuck due to the wedge shape of the handles.

European Patent Reference EP 1,514,497 A1 discloses stackable cutlery elements with a U-shaped cross-section in which projects fitted on the concave side of the handle can be engaged in recesses fitted on the convex side of an identical handle. A larger number of identical cutlery elements thus may be connected positively to a packaging unit after manufacture. The user must in each case irreversibly break off one cutlery element from the packaging unit by exerting force, which means that this arrangement is in principle not suitable for re-usable cutlery elements.

SUMMARY OF THE INVENTION

One object of this invention is to provide stackable cutlery elements of the type mentioned above which do not suffer from the disadvantages mentioned above and other disadvantages, and allows, in particular, high stacking density together with minimum material consumption.

This and other objects are achieved by a cutlery element of this invention having characteristics discussed in this specification and in the claims.

A cutlery element according to this invention includes a handle and a functional element shaped onto it, which element defines the use of the cutlery element. The most common cutlery elements are spoons, forks and knives.

To achieve maximum stability, the handle of the cutlery element of this invention is designed as a wall with longitudinal ribs arranged on both sides of it in the edge region so that an essentially H-shaped cross-section is obtained. For additional stabilization, an end rib is arranged on both sides of the wall on the longitudinal end of the handle opposing the functional element.

The end rib and the two longitudinal ribs on both sides are designed so that when the cutlery elements of this invention are stacked the end rib and the longitudinal ribs of the first side of a cutlery element engage positively in the end rib and longitudinal ribs of the second side of the further cutlery element connecting to it in the stacking direction.

The end rib and the longitudinal ribs of the handle of a cutlery element of this invention are advantageously designed so that the ribs have a first bevel on the first side of the wall or handle on the outer edge, such as on the edge of the ribs facing away from the wall. On the second side of the wall or handle the end rib and the longitudinal ribs have a second bevel on an inner edge facing the wall. This advantageous embodiment facilitates automatic centering of the individual cutlery elements of this invention when they are stacked. The demands for the required precision of production of the cutlery elements of this invention are also less as a result of adopting such a solution, which is advantageous for cost reasons.

In an even more advantageous embodiment of a cutlery element of this invention, the angle of inclination of the second bevel to the plane of the wall is smaller than the angle of inclination of the first bevel to the plane of the wall. The thus additional advantageous effect is that the points of contact of cutlery elements of this invention, stacked one on top of the other, are limited to the outer edge of the ribs of the first side. The individual sections can then be detached more easily from each other and the risk of becoming stuck is even lower.

BRIEF DESCRIPTION OF THE DRAWINGS

The cutlery element according to this invention is explained in view of the following drawings, wherein.

DETAILED DESCRIPTION OF THE INVENTION

Figure 1:
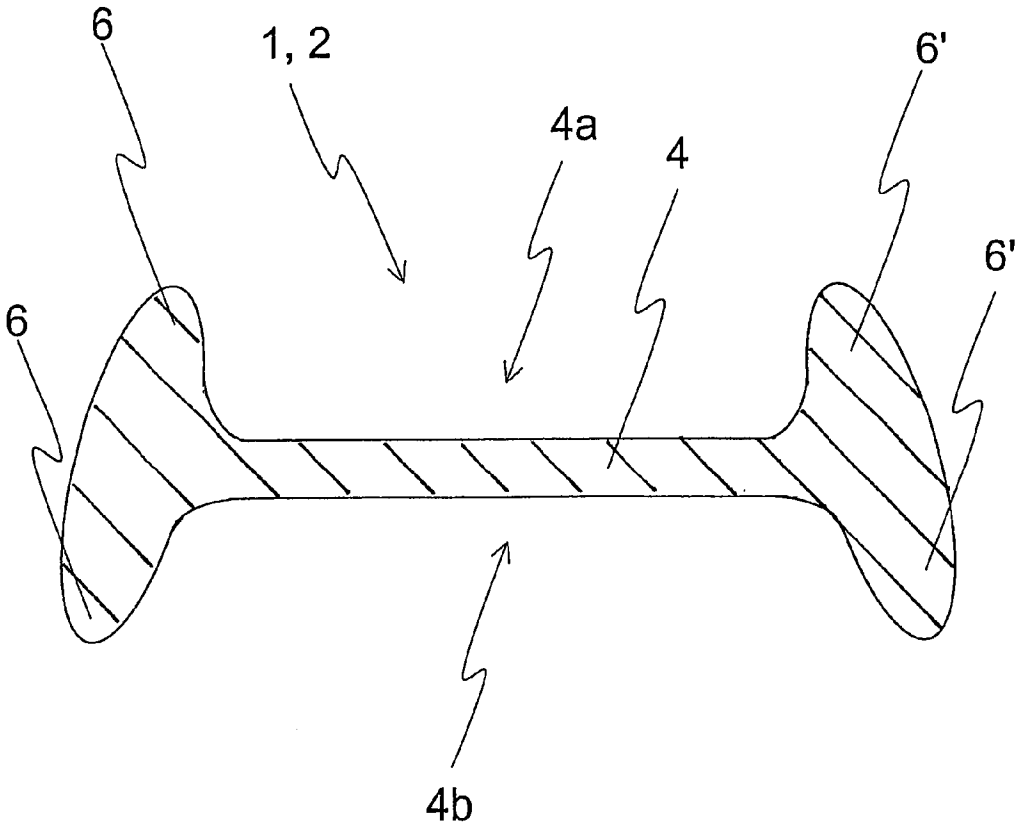
FIG. 1 shows a handle of a possible embodiment of a cutlery element of this invention, in a section taken perpendicular to a longitudinal axis of the handle.

FIG. 1 explains the structure of a cutlery element 1 of this invention with reference to a cross-section perpendicular to the longitudinal axis of handle 2 of cutlery element 1. Longitudinal ribs 6, 6' are shaped on the edges of the first side 4*a* and second side 4*b* of the wall 4 of handle 2.

Figure 1A:
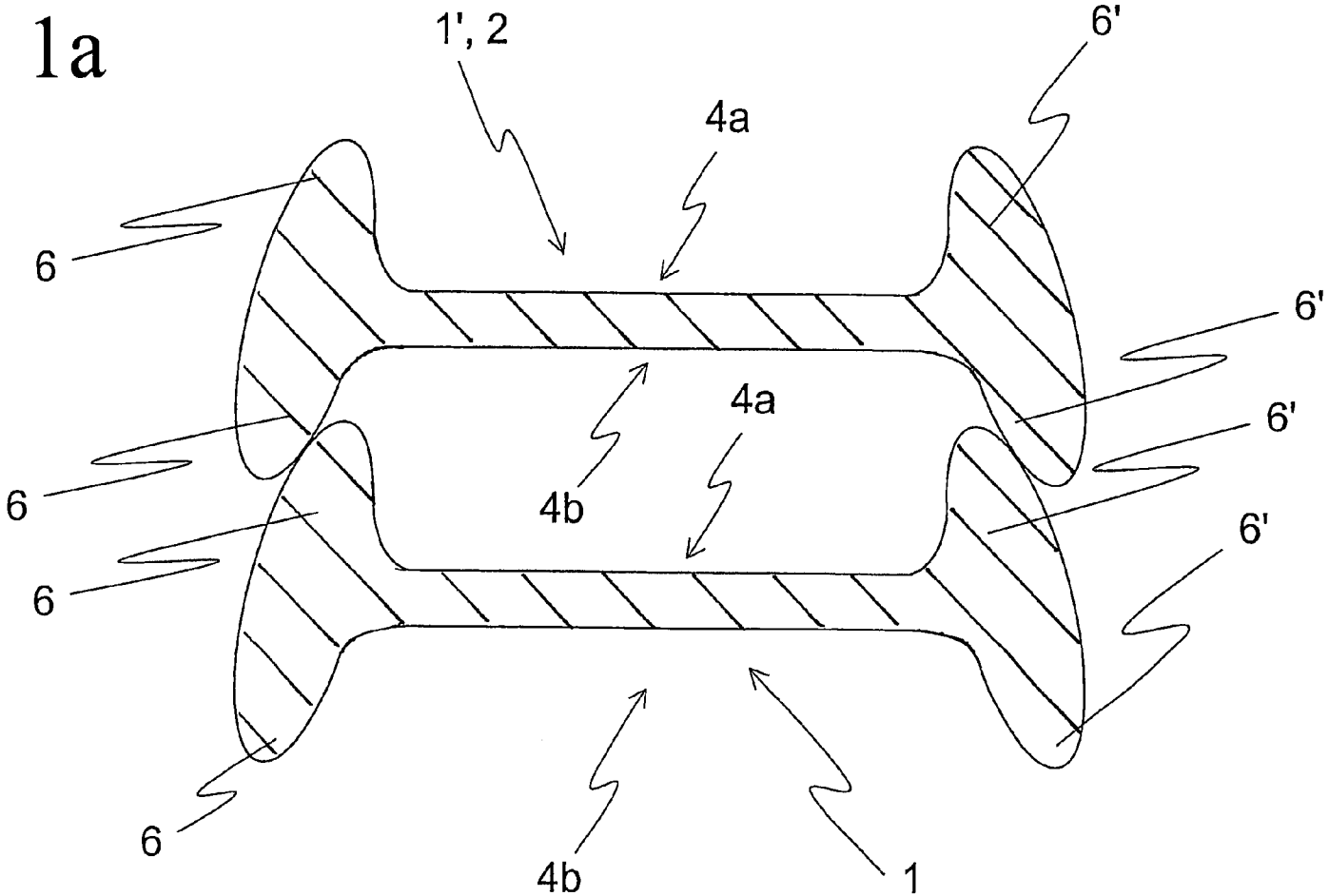
FIG. 1*a* shows two cutlery elements of this invention similar to FIG. 1, in a stacked arrangement, in a section taken perpendicular to the longitudinal axis of the handle.

As shown in FIG. 1*a*, the longitudinal ribs are designed so that when cutlery elements 1, 1' of this invention are stacked, ribs 6, 6' of first side 4*a* of a cutlery element 1 engage positively in ribs 6, 6' of second side 4*b* of the other cutlery element 1'. The same applies to the end ribs not shown in cross-section.

Figure 2:
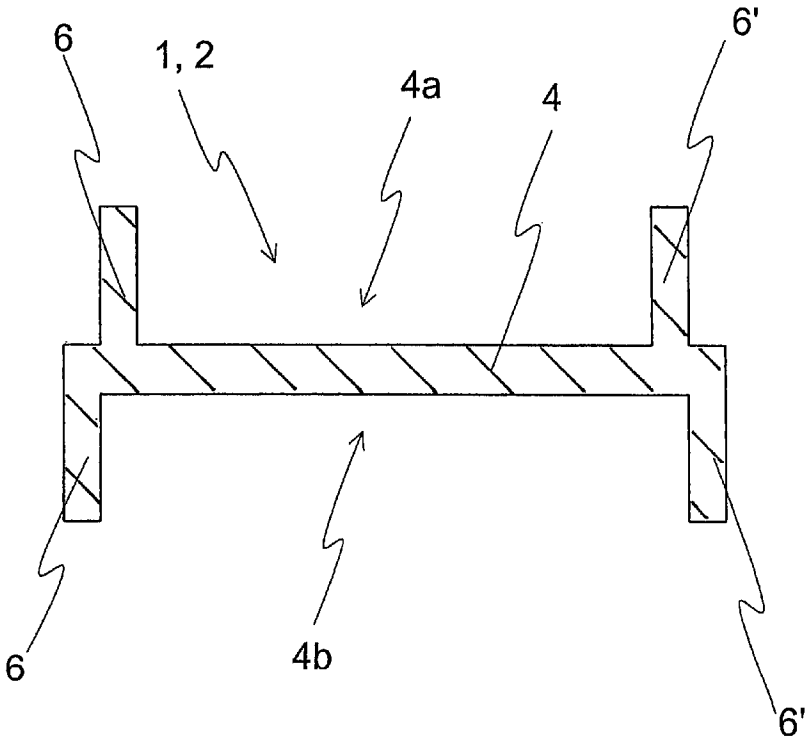
FIG. 2 shows the handle of another possible embodiment of a cutlery element of this invention, in a section taken perpendicular to the longitudinal axis of the handle.
Figure 2A:
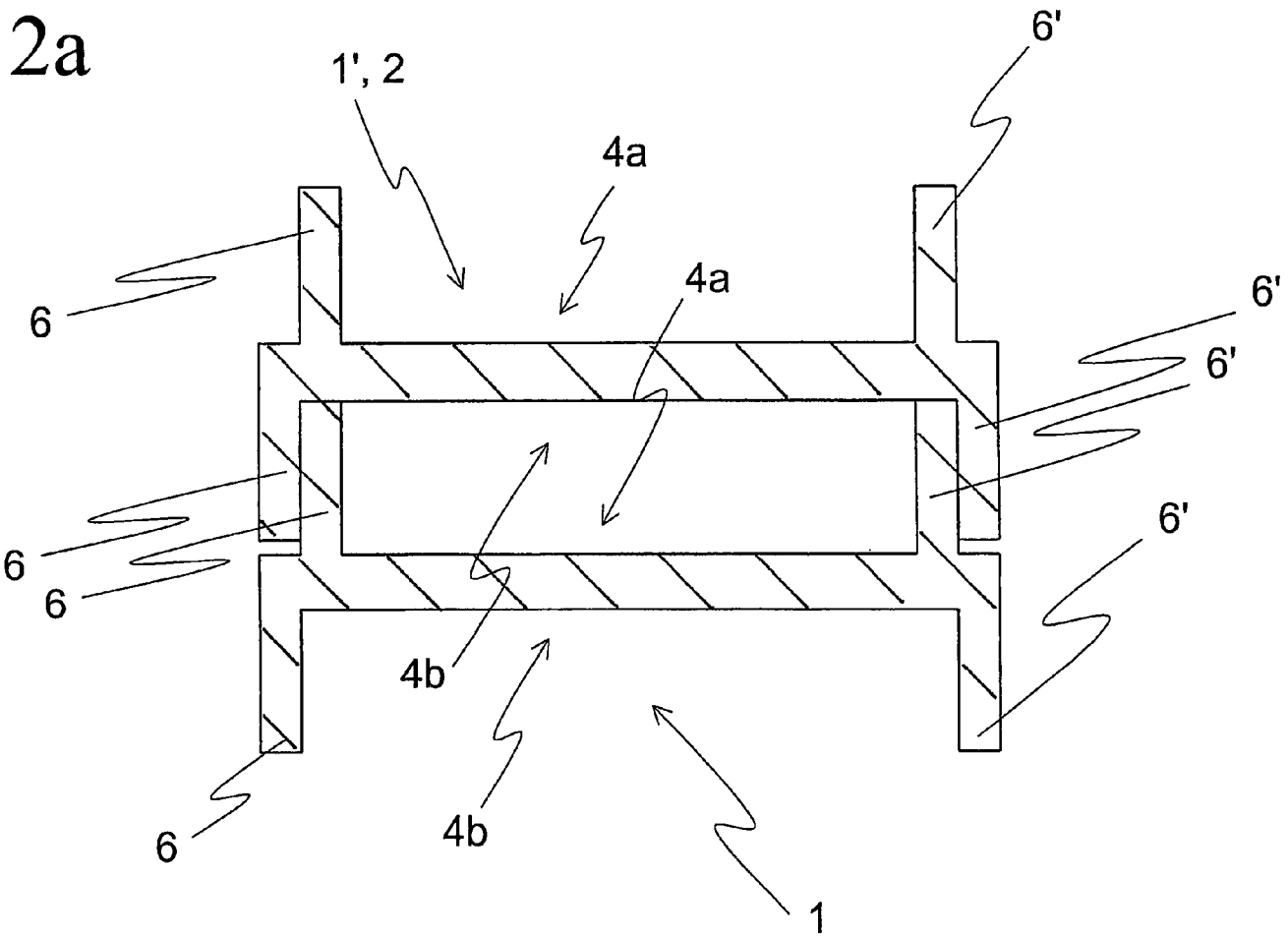
FIG. 2*a* shows two cutlery elements of this invention similar to FIG. 2, in a stacked arrangement, in a section taken perpendicular to the longitudinal axis of the handle.

FIGS. 2 and 2*a* show a further embodiment of a cutlery element 1 of this invention, in a cross-section taken through handle 2. Longitudinal ribs 6, 6' are arranged at right angles to the wall. Longitudinal ribs 6, 6' of first side 4*a* are offset toward the inside in relation to longitudinal ribs 6, 6' of second side 4*b*. When cutlery elements 1, 1' of this invention are stacked, longitudinal ribs 6, 6' of first side 4*a* of one of cutlery elements 1 stand upright on wall 4 of second cutlery element 1'.

Similarly the longitudinal ribs of second side 4*b* may also be designed so that they stand upright on wall 4.

Figure 3:
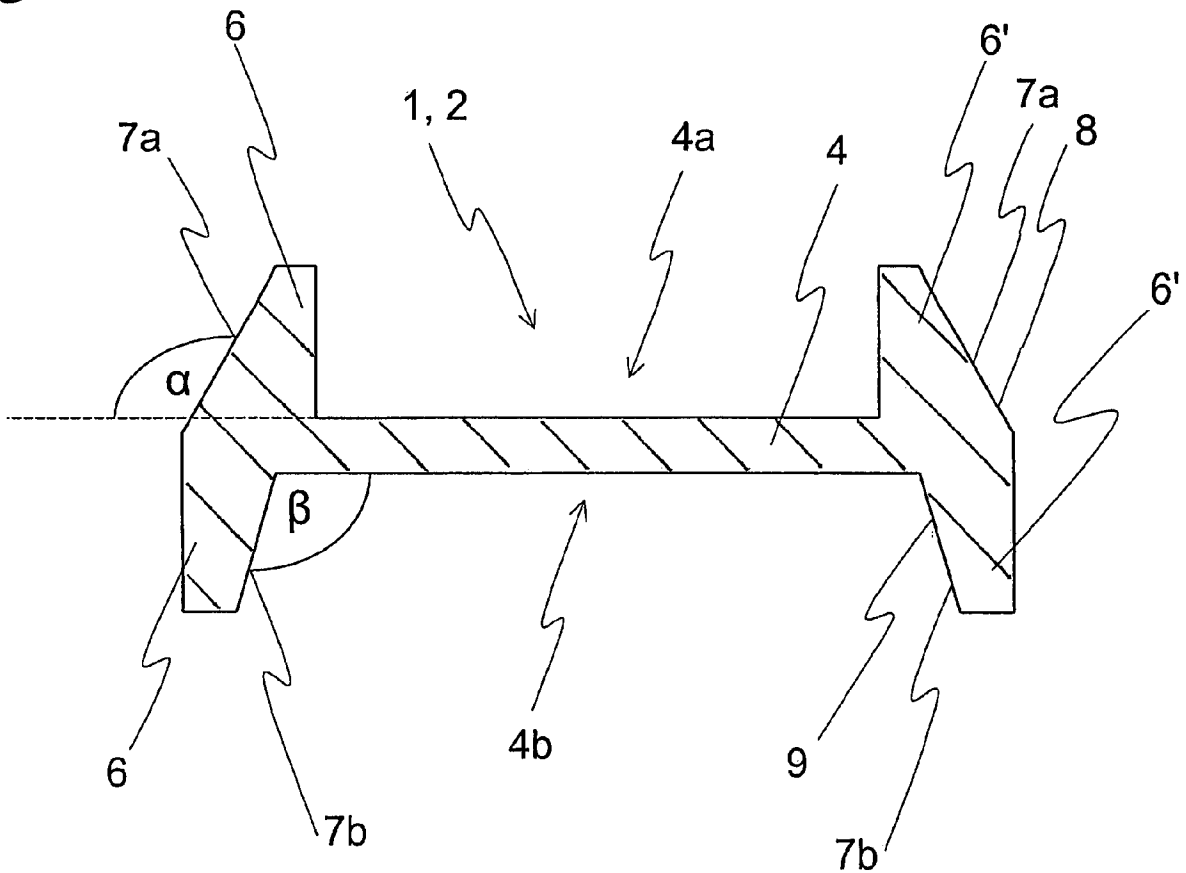
FIG. 3 shows a handle of another possible embodiment of a cutlery element according to this invention, in a section taken perpendicular to the longitudinal axis of the handle.

FIG. 3 shows a further preferred embodiment of a cutlery element 1 of this invention, in a cross-section taken through handle 2. In this case, longitudinal ribs 6, 6' of first side 4*a* have on outer edge 8 a first bevel 7*a*, and longitudinal ribs 6, 6' of second side 4*b* have a second bevel 7*b*. As shown, angle of inclination $\alpha$ of first bevel 7*a* to the plane of wall 4 is advantageously, but not necessarily, larger than angle of inclination p of second bevel 7*b* to the plane of wall 4. To avoid undercuts, p should be at least 90°.

Figure 3A:
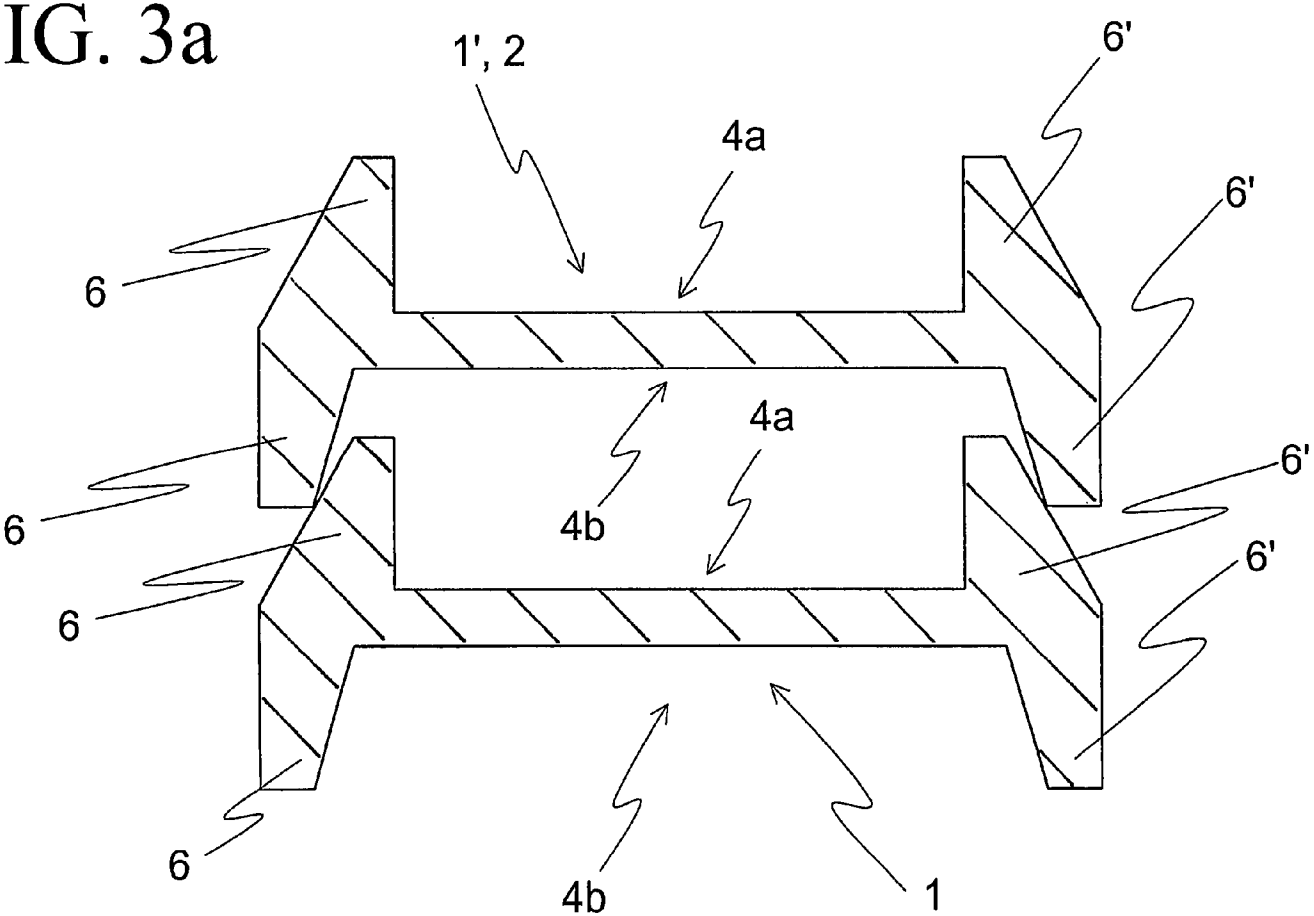
FIG. 3*a* shows two cutlery elements according to this invention similar to FIG. 3, in a stacked arrangement, in a section taken perpendicular to the longitudinal axis of the handle.

FIG. 3*a* shows two cutlery elements 1, 1' of this invention as shown in FIG. 3, when stacked. Longitudinal ribs 6, 6' of second side 4*b* of cutlery element 1 are only in contact with first bevel 7*a* of the additional cutlery element 1' with inner edge 9. In an alternative design, angles of inclination $\alpha$, $\beta$ may also be selected in reverse order so that angle of inclination a of first bevel 7*a* is smaller than angle of inclination $\beta$ of second bevel 7*b*.

To ensure that the cutlery elements can be easily removed from the mold and tool during the manufacture of the plastic cutlery elements of this invention, such as by injection molding, all the ribs are preferably designed so that they have no undercut.

Figure 4:
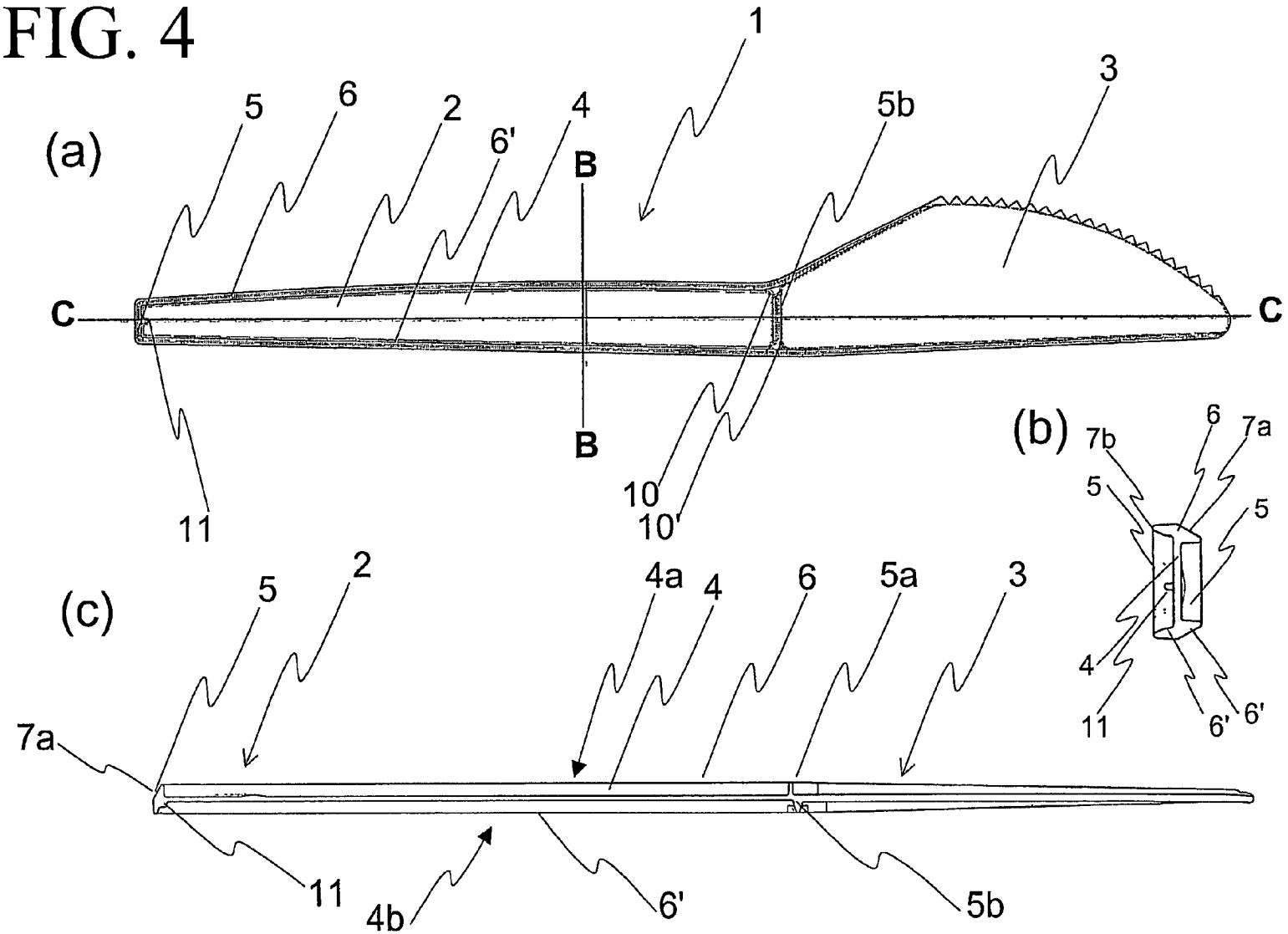
FIG. 4 shows yet another possible embodiment of a cutlery element of this invention, in the form of a knife, (a) in an elevation view, b) in a cross-section taken through the handle, and (c) in a longitudinal section taken through the handle.
Figure 5:
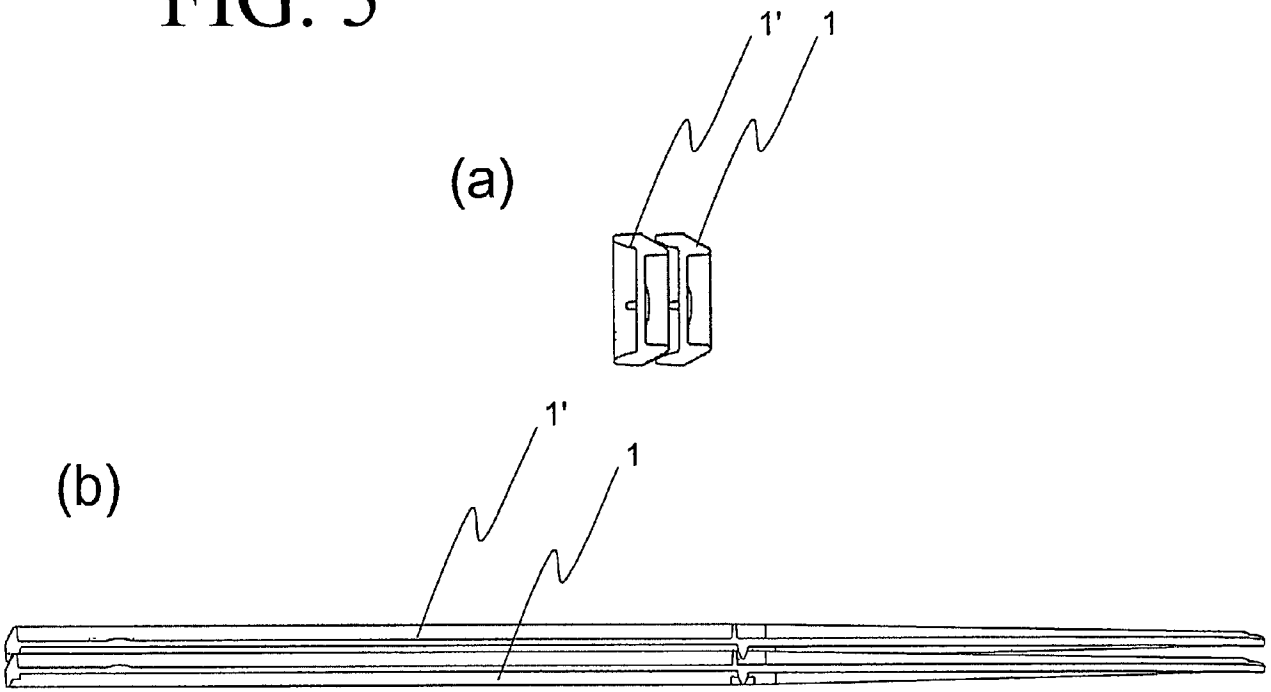
FIG. 5 shows two cutlery elements of this invention, similar to FIG. 4, in a stacked arrangement, (a) in a cross-section and (b) in a longitudinal section.
Figure 6:
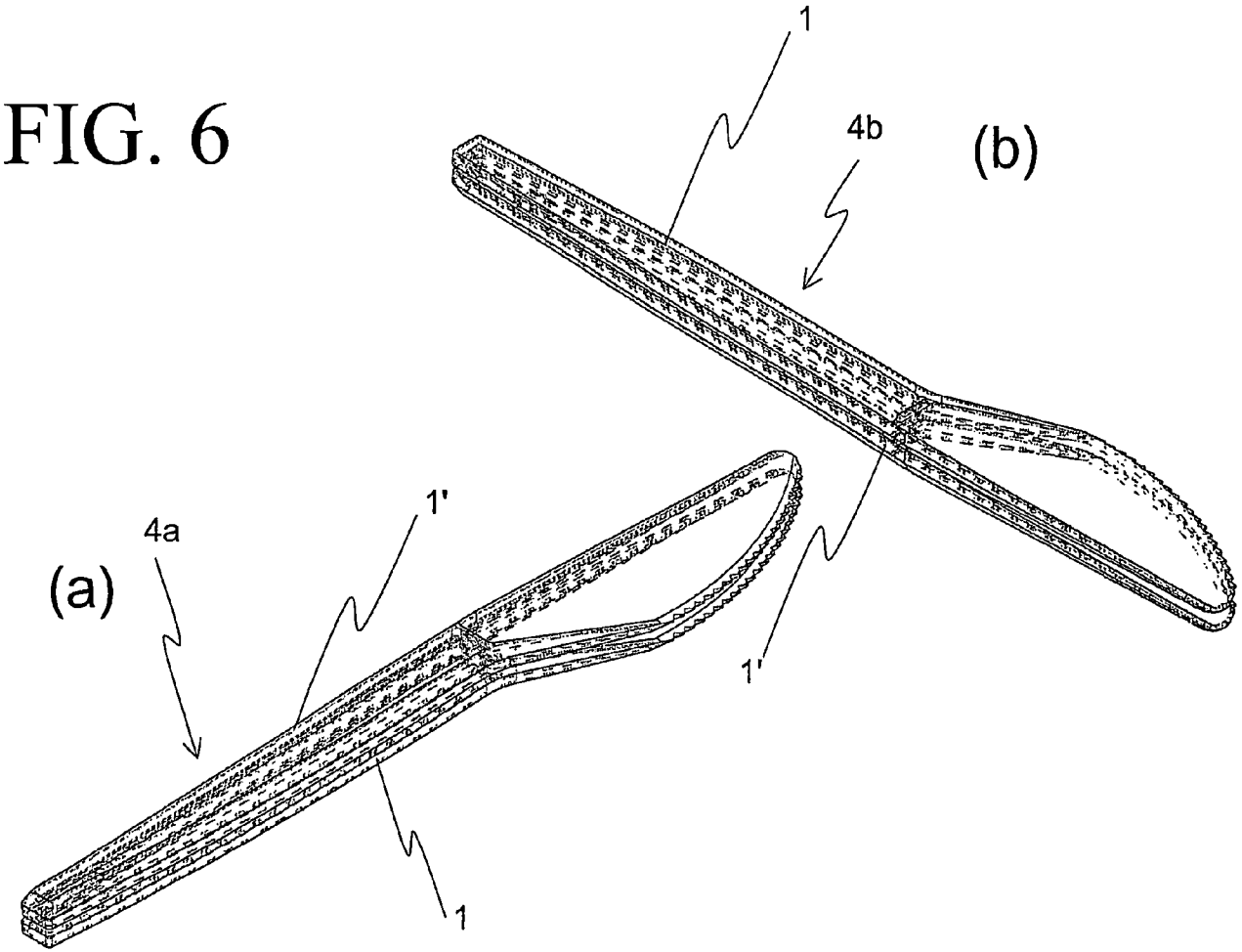
FIG. 6 shows the cutlery element of this invention as shown in FIGS. 4 and 5, as a wire model in a perspective view of (a) a first side and (b) a second side.

FIG. 4(*a*) shows an exemplary embodiment of a cutlery element 1 of this invention, taking the example of a knife, in an elevated view of second side 4*b*. Cutlery element 1 shown comprises a handle 2 and a functional element 3, in this case a blade 3. FIG. 4(*b*) shows handle 2 in a cross-section taken along line B-B, and FIG. 4(*c*) shows handle 2 in a longitudinal section taken along line C-C. For illustration purposes, cutlery element 1 of this invention, shown in FIG. 4, is also represented in FIGS. 6(*a*) and (*b*) as a wire model and in FIGS. 7 and 8, in a perspective view. FIGS. 5(*a*), 5(*b*) and 9 show two cutlery elements of this invention, similar to the example in FIG. 5, in a stacked arrangement.

In the example shown, longitudinal ribs 6, 6' extend over part of the outer edges of blade 3, which increases the stability of the blade. A similar procedure is also possible for other functional elements.

Figure 7:
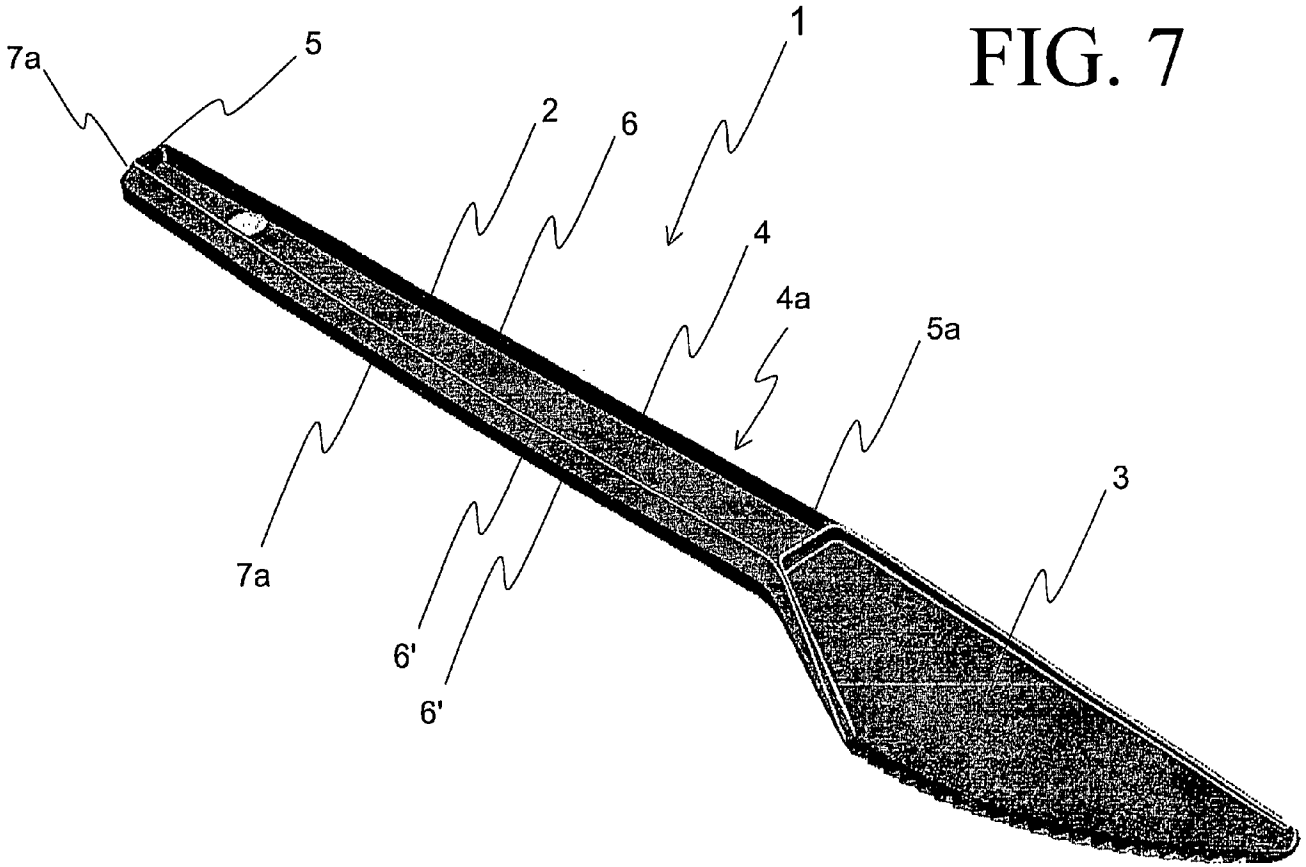
FIG. 7 shows the same cutlery element of this invention in a perspective view of the first side.
Figure 8:
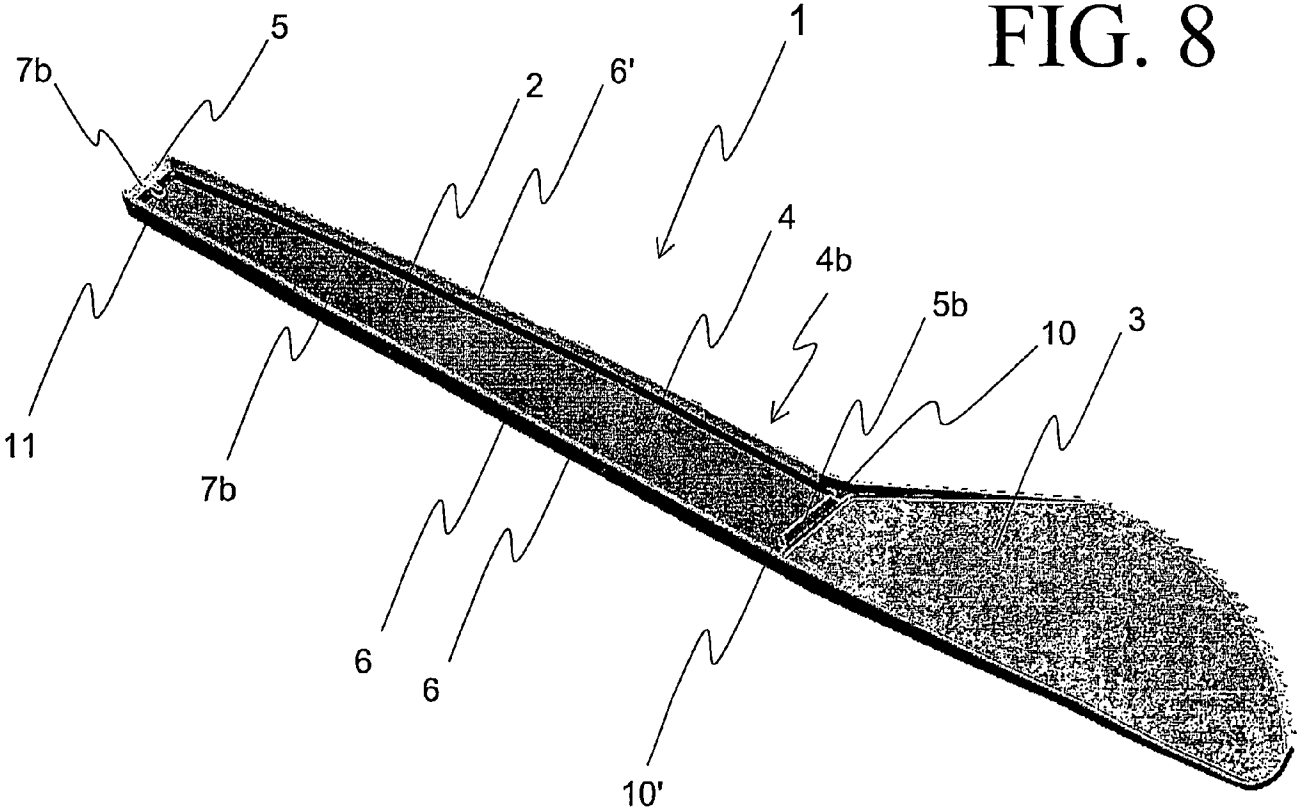
FIG. 8 shows the same cutlery element of this invention in a perspective view of the second side.
Figure 9:
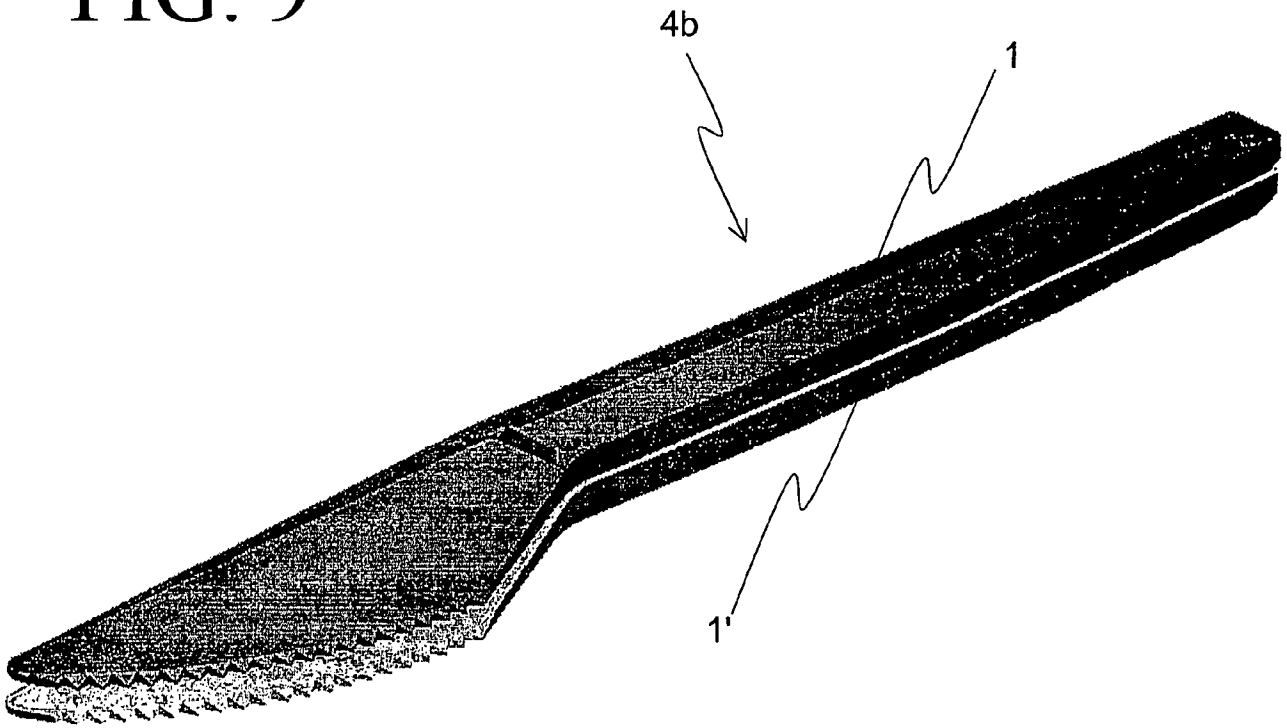
FIG. 9 shows two cutlery elements of this invention, in a stacked arrangement and in a perspective view.

FIG. 7 shows a first transverse rib 5*a* on first side 4*a* of cutlery element 1 of this invention, which rib is arranged essentially at right angles to longitudinal ribs 6, 6'. Similarly, FIG. 4(*a*) and FIG. 8 show a second transverse rib 5*b* on second side 4*b* of cutlery element 1. Two notches 10, 10' are made in second transverse rib 5*b* on the transitions of second transverse rib 5*b* into longitudinal ribs 6, 6'.

When a plurality of cutlery elements 1, 1' are stacked, longitudinal ribs 6, 6' of the first side of one of cutlery elements 1 lie in notches 10, 10' of second transverse rib 6*b* on second side 4*b* of the other cutlery element 1'.

First transverse rib 5*a* is arranged so that when a plurality of cutlery elements 1, 1', are stacked, first transverse rib 5*a* lies flush with transverse rib 5*b* of a further cutlery element 1', on the side of rib 5*b* opposing functional element 3.

In an alternative embodiment, the arrangement may be the reverse.

The invention claimed is:

1. A stackable cutlery element (1) with a handle (2) with a wall (4) and a functional element (3) shaped onto the handle (2), wherein one end rib (5) and two longitudinal ribs (6, 6') are arranged on a first side and a second side (4*a*, 5*b*) of the handle (2) to project from the wall (4), and the end rib (5) and the longitudinal ribs (6, 6') are designed so that when a plurality of cutlery elements (1, 1') are stacked, the end rib (5) and the longitudinal ribs (6, 6') of the first side (4*a*) of a cutlery element (1) engage positively in the end rib (5) and the longitudinal ribs (6, 6') of the second side (4*b'*) of a further cutlery element (1'), the cutlery element (1) comprising:

on the first side (4*a*) the end rib (5) and the longitudinal ribs (6, 6') having a first bevel (7*a*) on an outer edge (8) facing away from the wall (4), and on the second side (4*b*) the end rib (5) and the longitudinal ribs (6, 6') having a second bevel (7*b*) on an inner edge (9) facing the wall (4), the second bevel having an angle of inclination to the wall (4) that is smaller than or greater than an angle of inclination of the first bevel (7*a*) with respect to the wall (4), wherein a first transverse rib (5*a*) is arranged on the end of the handle (2) opposing the end rib (5) on the first side (4*a*) of the wall (4), and a second transverse rib (5*b*) is arranged on the second side (4*b*) of the wall (4), wherein the second transverse rib (5*b*) has two notches (10, 10') into which the longitudinal ribs (6, 6') on the first side (4*a*) of the wall (4) of a further cutlery element (1') engage when a plurality of cutlery elements (1, 1') are stacked.

2. The cutlery element according to claim 1, wherein the first transverse rib (5*a*) is arranged so that when a plurality of the cutlery elements (1, 1') are stacked, this first transverse rib lies flush with the second transverse rib (5*b*) of a further cutlery element (1) on the side opposing the functional element (3).

3. The cutlery element according to claim 1, wherein the end transverse rib (5) has on the second side (4*b*) of the wall a projection on which the end transverse rib (5) on the first side (4*a*) of the wall (4) of a further cutlery element (1') lies when a plurality of cutlery elements (1, 1') are stacked.

4. The cutlery element according to claim 1, wherein the cutlery element (1) is a knife, a fork or a spoon.

* * * * *